United States Patent [19]

Vargas

[11] 4,183,219

[45] Jan. 15, 1980

[54] SELF STARTING HOT GAS ENGINE WITH MEANS FOR CHANGING THE EXPANSION RATIO

[76] Inventor: Eduardo A. Vargas, Av. Bogota 697, Mexico City 14, Mexico

[21] Appl. No.: 771,957

[22] Filed: Feb. 25, 1977

[51] Int. Cl.[2] ..... F02G 1/02

[52] U.S. Cl. ..... 60/682; 60/652

[58] Field of Search ..... 60/516, 645, 650, 682, 60/695, 517, 652

[56] References Cited

U.S. PATENT DOCUMENTS

| | | | |
|---|---|---|---|
| 431,729 | 7/1890 | Ericsson | 60/516 |
| 668,200 | 2/1901 | Myers | 60/682 |
| 1,164,960 | 12/1915 | Ray | 60/682 X |

FOREIGN PATENT DOCUMENTS

| | | | |
|---|---|---|---|
| 558883 | 2/1975 | Switzerland | 60/517 |

*Primary Examiner*—Allen M. Ostrager
*Assistant Examiner*—Stephen F. Husar
*Attorney, Agent, or Firm*—Charles Richard Werner

[57] ABSTRACT

A reciprocating hot gas engine adapted to provide a self-starting, controlled expansion, and a long time working fluid heating inside heaters placed in a combustion chamber separated from the engine compression and expansion cylinders of the engine.

10 Claims, 17 Drawing Figures

SELF STARTING HOT GAS ENGINE WITH MEANS FOR CHANGING THE EXPANSION RATIO

BRIEF SUMMARY OF THE INVENTION

This invention relates in general to a reciprocating motion hot gas engine, comprising a bank of compression cylinders and a bank of expansion cylinders in which pistons are connected by means of connecting rods to a common crankshaft, by different devices involved in this engine which has the following characteristics: stores and cools their working fluid between the compression and expansion stages, selfstarting with or without load. The working fluid heating starts at the very moment when the previous expanding cycle ends in the same expansion cylinder and an almost continuous long heating time. The expansion ratio between the heaters and expansion cylinders may be variable. These features, novel to this engine, make it different from known engines of the reciprocating movement type in which the working fluid is a noncondensing gas, but the performance of my engine is more comparable to the reciprocating steam engines, particularly in the output torque and power developed. My engine may work with heating at a constant volume, constant pressure, or dual between both processes with the only difference being in the volume of the working fluid heaters and may burn almost any kind of fuel: liquid, gaseous or even a solid fuel. The present description which is the preferred embodiment, is for constant volume heating due to the specific heat of the gases being lower when heated at constant volume, which is an evidence of higher thermal efficiency. For this reason, this engine functions in a cycle near to the Stirling cycle, but different from the known engine working in this cycle, my engine which controls the total working fluid flow by means of valves, does not require a regenerating thermal system between the compression and expansion cylinders, and for this reason there are almost no "dead volume spaces" which are only to the clearances between the compression and expansion pistons with their corresponding cylinder heads and the inlet valve outlet duct in the expansion cylinders. The volume of the heaters is completely independent and is not a part of the compression or expansion cylinders clearance. The volume due to the expansion cylinders clearances and inlet valve outlet ducts, is compensated, and it is possible to consider that there are no dead volume spaces.

On the other hand, as the working fluid is steady, inside the heaters during heating, free from natural disturbances as is known in Stirling cycle engines due to the continuous motion between their displacer, or compression and expansion pistons, and the absence of dead spaces, this engine does not require high pressures in the order of 200 atmospheres.

This description is based on an engine with a compression ratio of 7:1, which is equivalent to those in a low compression ratio Otto cycle internal combustion engine, and the thermal and mechanical stresses are similar between both engines. This is evidence that this engine may be built with almost the same materials, tooling and technology as the present Otto cycle engines.

DETAILED DESCRIPTION OF THE PREFERRED EMBODIMENT

Figure 1:
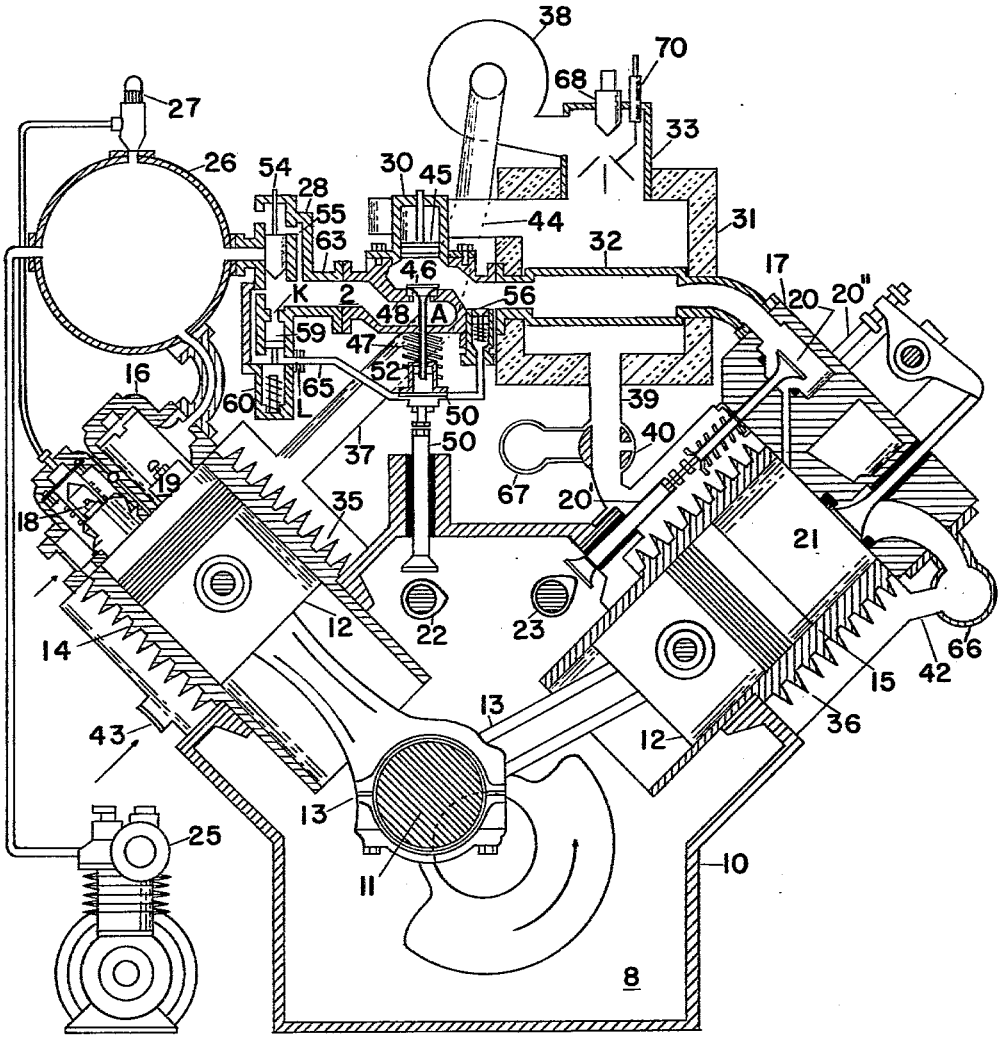
FIG. 1 is a vertical cross sectional view of the engine during the expansion cycle, parts being shown in elevation.

The present invention is illustrated in the accompanying Figures wherein similar components are indicated by the same reference numeral throughout the several views.

This description is for an engine with three compression and three expansion cylinders, with the same bore and stroke with their pistons 120° out of phase between them.

Reference is now made to FIG. 1, where the engine 8, comprising a crankcase with cylinders 14 and 15 in a "V" arrangement, whereby the cylinders 14, operate only as compressors, where each upward travel is a compression stroke, and each downward travel is an suction stroke. Each cylinder 14 has a head 16, with an intake valve 18, and one discharge valve 19, both valves being operated by means of the working fluid pressure difference flowing therethrough.

The cylinders 15 operate only as expanders where each downward travel is an expansion (power) stroke and each upward travel is an exhaust stroke, each cylinder 15, having a head 17, with an intake valve 20, and an exhaust valve 21. Both valves are driven by means of the camshaft 23 through rods 20' and 20'' at the same rotational speed as crankshaft 11. The compression cylinders 14, and the expansion cylinders 15 have the pistons 12 connected to crankshaft 11, through connecting rods 13.

The working fluid is compressed into compression cylinders 14, and does not flow directly and immediately to the heaters 32, and expansion cylinders 15, but is cooled and stored in reservoir 26. Between both banks of cylinders 14 and 15, are located the following devices.

Connected to discharge valves 19, from compression cylinders 14, is the reservoir 26, and connected to same, is the unloader valve 27, which actuates through intake valves 18, when the pressure on reservoir 26, reaches the governed pressure and cylinders 14, go to idle.

Valve 27 is also used to send cylinders 14 to idle temporarily in order to get a higher output torque and power in crankshaft 11, which is obtained by reducing the power required to drive the compression cylinders 14.

START AND THROTTLE VALVE 28

At outlet reservoir 26, there is the start and throttle valve 28 which is used to start and control the speed of engine 8, said valve being shown in FIG. 1 and in enlarged scale in FIG. 2 at the left side, and has two independent portions, the upper portion being the throttle valve and the lower portion being the starting valve and operates as follows.

When engine 8 is at a standstill, the needle valve 54, is in the bottom stroke, pressed against its seat, and the working fluid is not flowing through it from the reservoir 26, to the feed valves assembly 2, connecting at the same time the intake manifold 63, to the atmosphere through the duct 55, and the orifice "H".

The piston 59, is held in its top stroke by means of the spring 60, the central groove of the piston 59 connects the pipes 65, through the duct 64, to the intake manifold 63, and are connected to the atmosphere, while the valve 54, is at the bottom of its stroke. When needle valve 54, is lifted to start up the engine 8, the upper face of valve 54, begins to close the orifice "H" and close the communication from the intake manifold 63, to the atmosphere. When the orifice "H" is completely closed, the needle valve 54, begins to open the communication from the reservoir 26, to the chambers "A" of feed valves assembly 2 and at the same time the upper face of piston 59 through the calibrated orifice "K".

In the expansion cylinders 15, whose pistons 12 are beyond their top dead center working fluid at the pressure of reservoir 26 flows through the duct 64, the central groove of piston 59, pipes 65, valves 56, heaters 32, and intake valves 20, (by-passed the feed valve assemblies 2) and the working fluid pressure acts over to the upper face of pistons 12 and the crankshaft 11, begins to rotate, developing a useful output torque, but at the same time the working fluid will flow through the reduced orifice "K", and begin to push the piston 59 at a controlled speed, and the upper face of their central groove closes the orifice "L", interrupting the working fluid flow from intake manifold 63, during all the time valve 28 is open and engine 8 is running.

The purpose of reduced orifice "K" is to control the downward speed of piston 59 to reduce the working fluid pressure in reservoir 26, to the intial revolution of crankshaft 11, when engine 8 is started up.

When valve 54 is impelled downwardly against the valve seat to turn off engine 8, the working fluid flow to the feed valve assemblies 2 is interrupted and at the same time the intake manifold 63 will be opened to the atmosphere in the same way as previously described, and the upper face of piston 59 will be connected to the atmosphere through the same orifice "K". The spring 60 will push the piston 59, upwardly to again be in "start" position.

FEED VALVE ASSEMBLY 2

Figure 2:
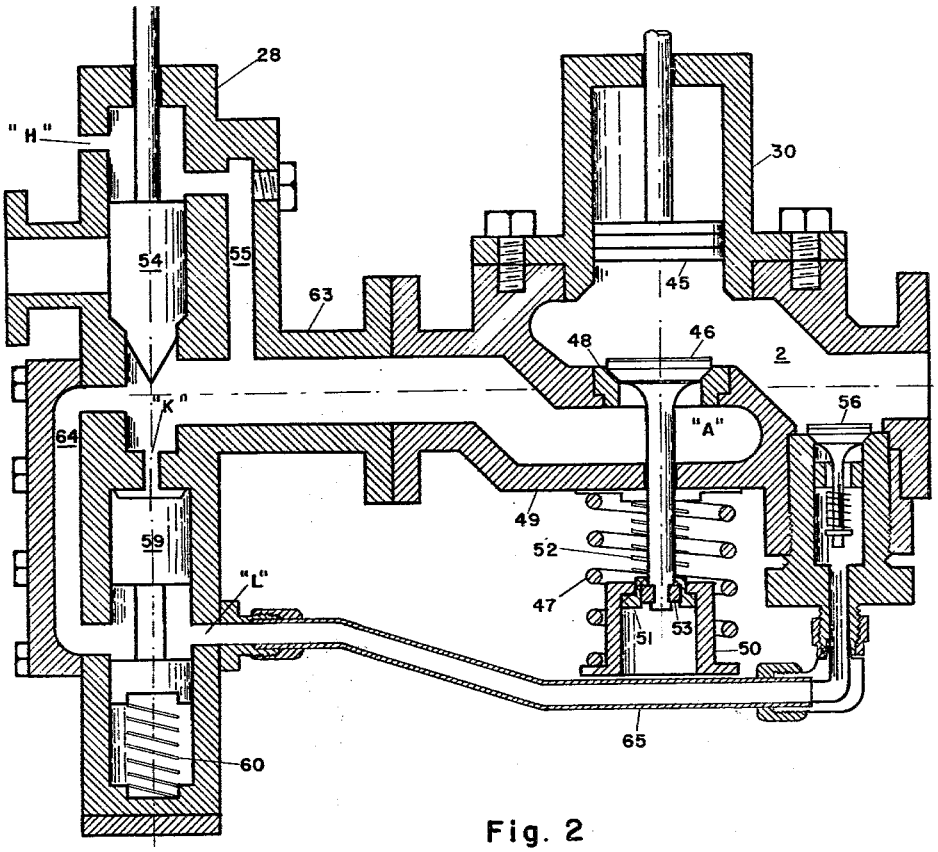
FIG. 2 is an enlarged longitudinal view of the starting and throttle valve, feed valve and working fluid accumulator.

In each intake manifold outlet 63 there is located a feed valve assembly 2, with the respective working fluid accumulator 30, one for each expansion cylinder 15, the valve 46 being driven by means of camshaft 22, through rods 50' at the same rotational speed as crankshaft 11, the right side of FIG. 2, showing in sectional view said feed valve assembly 2.

The function of said feed valve assembly 2, is to control the working fluid flow from reservoir 26, to the heaters 32, and accumulators 30. The poppet check valve 46, has the characteristics of a fixed opening point and a variable closing point, functioning as follows.

When valve 28 is closed, the valves 46 are at the bottom of their stroke, urged into closed position against the valve seat 48 by means of spring 47, which acts between the lower side of housing 49 and upper face of lower spring plate 50, which at the same time pushed over the set sleeve 51, upper face and wedges 53, which are fixed to the stem of valve 46. Spring 52 also helps to quickly close the valves 46, by acting between the lower side of housing 49 and set sleeve 51.

Figure 2B:
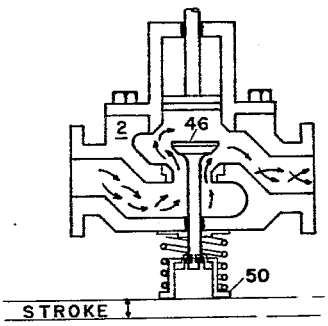
FIG. 2*b* is a reduced longitudinal view of the feed valve assembly with the lower spring plate on top of stroke and the poppet check valve closed.
Figure 2C:
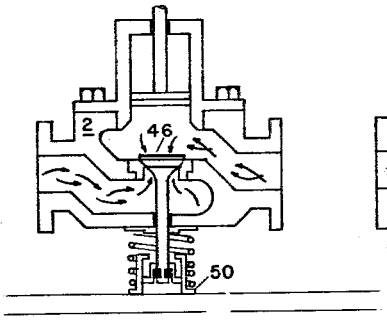
FIG. 2*c* is a reduced longitudinal view of the feed valve assembly with the lower spring plate at bottom of the stroke and poppet check valve closed.
Figure 2A:
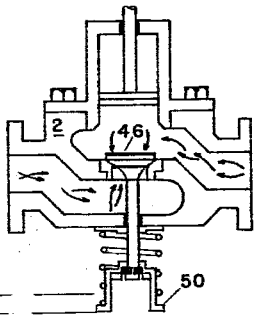
FIG. 2*a* is a reduced longitudinal view of the feed valve assembly with the lower spring plate on top of stroke and the check poppet valve opened.

When valve 54 is lifted to start up the engine 8, there will be a constant working fluid pressure inside chambers "A", which acts against the lower face of valve 46. However, this pressure is insufficient to open the valve 46 due to spring 47, acting in the opposite direction with enough force to overcome the working fluid pressure which is acting against the lower face of valve 46, as shown in FIG. 2*a*, with the exception of those feed valve assemblies 2, whose lower spring plates 50, are in the upper stroke, overcoming the force of spring 47, as shown in FIG. 2*b*. In these last valves the working fluid forces the valves 46, upwardly (open fixed point), and flows past the valves and remaining trapped inside the heaters 32, and accumulators 30, building up pressure until the pressure is the same over both faces of valve 46, closing same by means of the spring 52 which forces valve 46 to close at higher speed, (variable closing point), as shown in FIG. 2*c*. Nevertheless, lower spring plate 50, remains at its upper stroke and does not reopen while exposed to the working fluid pressure over the upper face of valve 46, and when the pressure inside the heaters 32, during the expansion process is reduced to a lower pressure than that on reservoir 26, valve 46 will be steadily seated against the seat 48, by means of spring 47, as shown in FIG. 2*a*. Spring 52, is too light and has only enough force to maintain valve 46 closed, when there is no working fluid pressure inside the chamber "A".

As valve 46 has a mechanically driven fixed point for its opening and a pneumatically driven variable point for its closing, the time between both points is the time during which valve 46 opens and depends only on the combined volume between the heater 32, and the accumulator 30, the aperture of valve 54, the temperature of heater 32, the working fluid temperature and pressure inside the reservoir 26, which always and invariably are combined between them in different proportions, but valve 46, always closes when the pressure on heaters 32 and reservoir 26 are equal, regardless of the factors before mentioned and the opening time of valve 46.

Integral with feed valve assembly 2, above upper face of the valve 46, is located the working fluid accumulator 30, which has a variable volume, said accumulator operating manually or automatically, the working fluid trapped in the space defined by the heater 32, the lower face of piston 45, the valve 46, and intake valve 20, the last mentioned valve remaining closed until the pistons 12 reach their top dead center.

By means of variation of the working fluid trapped inside the heaters 32, and accumulator 30, and combined with opening of the valve 54, it is possible to control at the same time the output torque and rotational speed developed by crankshaft 11.

The accumulator 30, having integral moving parts, is not exposed to direct fire inside combustion chamber 31, but is placed in the combustion extension chamber 31A, where it is heated by the combustion chamber 31, hot gases flowing through the duct 44, to the combustion extension chamber 31A.

WORKING FLUID HEATERS 32

In the outlet of feed valve assembly 2, and inside combustion chamber 31, are located the working fluid heaters 32, one for each expansion cylinder 15, which heats the working fluid in three stages; the first stage starting the instant valve 46 opens until the instant it closes, which is the time required to fill the heater 32. The working fluid is heated at a constant pressure. The second stage starts the instant valve 46 closes until intake valve 20 opens, the heating being at true constant volume. The third heating stage starts the instant intake valve 20 opens at the top dead center and during all the expansion time until exhaust valve 21 opens, and the working fluid begins to exhaust.

On the outlet side of heaters 32, there are intake valves 20, which are operated by camshaft 23, at the same rotational speed as crankshaft 11, which connects the heaters 32 to the expansion cylinders 15, so the working fluid has risen to the maximum pressure and temperature inside the heaters 32, during the constant volume heating discharges over the upper face of expansion piston 12, during the expansion process (power).

AUXILIARY COMPRESSOR 25

In FIG. 1, the lower portion on the left side, there is the auxiliary compressor 25, which is driven independently from the engine 8, and acts to maintain the reservoir 26 fully charged when engine 8 is at standstill with the same pressure as that developed by compression cylinders 14.

As reservoir 26 is permanently charged and at the same pressure as that developed by the compression cylinders 14, it is possible to start up engine 8, as previously described, and if said engine has three or more expansion cylinders 15, with their pistons 12 out of phase in angles equal to 360 divided by the number of said cylinders the engine 8 always can start up in any position of crankshaft 11 developing the maximum output torque or nearly close to the maximum, which is determined only by the crankshaft position and expansion pistons 12, which are in an expansion cycle.

Auxiliary compressor 25 also acts as a booster when it is running at the same time as the engine 8, due to the fact it furnishes an additional working fluid volume, sufficient to maintain filled at the same time the heaters 32, and the accumulators 30. The function of compressor 25, as a booster, is described in paragraph "Working fluid accumulators 30, addition".

Compressor 25, may also be one with a higher pressure discharge than that of the compression cylinders 14, and discharging into a higher pressure reservoir (not shown), for extracting directly from this reservoir and for short time periods the working fluid at a higher pressure, to increase the maximum and medium effective pressure into expansion cylinders 15. In such case, the high pressure reservoir also feeds the reservoir 26, through a pressure reducing valve (not shown), to furnish the same pressure as is developed by compression cylinders 14, in the same way as the low pressure compressor 25, discharging direct into reservoir 26.

As the function of working fluid compression and expansion are separated each one in a cylinder bank, only the expansion cylinder 14, is described, due to the compression cylinders functioning as any reciprocating compressor, independently but driven by the same crankshaft 11.

EXPANSION CYLINDERS 15

Expansion cylinders 15, with their pistons 12, have two working cycles as follows:

1. Expansion, with an effective stroke from the top dead center up to the moment in which exhaust valve 21, opens, approximately 160°.
2. Exhaust, which starts before intake valve 20 closes, and ends before the top dead center, for compressing a small working fluid volume remaining inside the cylinders 15, to fill the small volume due to piston clearance, including the outlet duct of intake valve 20, with approximately the same pressure as that inside the heaters 32, in order to prevent a pressure loss when intake valve 20 opens.

At the expansion cycle end, there is an overlap between the intake 20, and exhaust valve 21, where both valves remain open at the same time, whereby the pressure inside the heater 32, and expansion cylinder 15, will be reduced simultaneously.

VALVE TIMING

Figure 3:
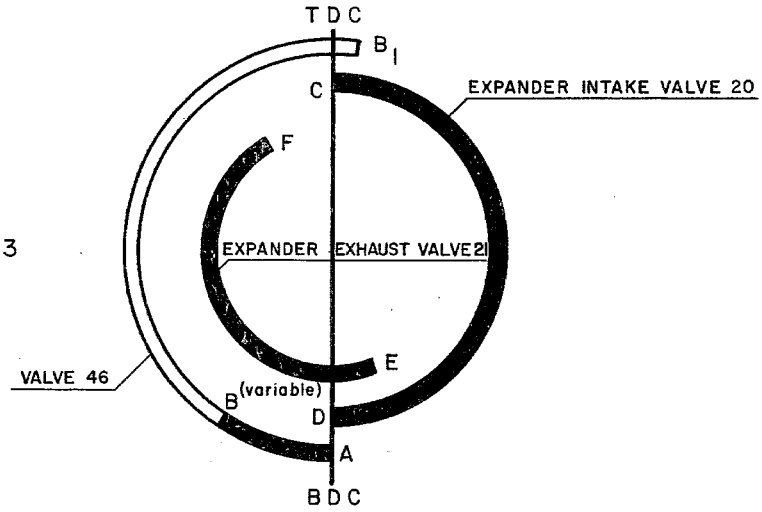
FIG. 3 is a theoretical valve timing diagram for the expander inlet valves, the expander exhaust valves and the feed valves assembly.

FIG. 3, shows a diagram with the theoretical valve time opening for feed valves 2, intake valves 20, and exhaust valves 21. Starting the cycle at the bottom dead center with intake valve 20 closed, point "D", camshaft 22, opens the valve 46, point "A", starting to fill the heater 32 and the first heating stage, valve 46, will remain open until the pressure of heater 32, will close, point "B" (variable) beginning at this instant the second heating stage. At the top dead center, camshaft 23 opens the intake valve 20, point "C", starting the third heating stage during all the expansion cycle, about 160° rotation angle of crankshaft 11, until the exhaust valve 21 opens.

Before the bottom dead center is reached, the camshaft 23 opens the exhaust valve 21, and working fluid begins to exhaust to the atmosphere through the exhaust manifold 66, ending the working fluid heating, point "E"; exhaust valve 21, remaining open for about 170°, and closing at point "F" before top dead center is reached.

Between the instant valve 21 opens, point "E", and the instant at which intake valve 20 closes, point "D", at the bottom dead center, the valves overlap between admission valve 20, and exhaust valve 21.

Between the time intake valve 20 opens, point "C", and exhaust valve 21 opens, point "E", is the angle of the effective stroke of expansion piston 12.

Between the time exhaust valve 21 closes, point "F", and intake valve 20 opens, point "C", is the angle which cylinder 15, and piston 12, function as compressor to compensate their own clearance.

Between the point "A", to the point "$B_1$" is the angle or time at which valve 46 can be opened, provided there is no heater 32 pressure against their upper face.

HEATING AND COOLING SYSTEMS

As compression cylinders are on one bank and expansion cylinders on the other bank, there is a cool cylinder bank while the other one is hot, whereas both cylinder banks function closest to their isothermal process, if compression cylinders 14 are cooled and expansion cylinders 15 are maintained hot, even with the engine 8 working at reduced load or in standby.

As previously mentioned it is possible by means of the combustion chamber electrical burner fan 38, which draws air for fuel combustion through duct 43, to cool the compression cylinders 14 inside the cooling chamber 35, continuing through pipe 37, to burner fan 38, and being discharged into the combustion chamber cupola 33, where increases considerably the temperature by means of fuel combustion, atomized by nozzle 68, and ignited by electrodes 70, heating the heaters 32, and accumulators 30, being discharged through pipe 39, flowing through the three way valve 40, (if it is opened) to heater chamber 36, to heat the expansion cylinders 15, and being discharged to the atmosphere through the duct 42, which connects the expansion cylinders 15, to the exhaust manifold 66.

As the expansion cylinders 15 also are heated by the same working fluid when engine 8, is running, valve 40 is thermostatically actuated, to control the combustion gas flow from combustion chamber 31, to the heating chamber 36, to maintain a constant temperature regardless of the load rate, or to preheat the expansion cylinders 15, before engine 8 is running or furnishing additional heat when operating at reduced load, to increase the thermal efficiency. When valve 40 closes the flow to the heater chamber 36, combustion gases are discharged to the atmosphere through the duct 67.

ENGINE OPERATIONAL SEQUENCE

As a working example for engine 8, it is considered that before the engine begins to run, the pistons 12, corresponding to the expansion cylinders are: the first, on the top dead center, the second, 120° before the top dead center, and the third, 120° after the top dead center.

When valve 54 is lifted, the working fluid stored in reservoir 26, which is at the discharge pressure of compression cylinders 14, flows from one side through feed valve assemblies 2, which corresponds to the first and second expansion cylinders in which their lower spring plates 50 are in their upper stroke, but as the intake valves 20, correspond to these expansion cylinders, they are closed, the working fluid remains trapped inside the heaters 32, which corresponds to these expansion cylinders 15, beginning the heating of the working fluid and as a consequence a pressure increase.

On the other hand, in the third expansion cylinder 15, the working fluid flows from valve 54, through duct 64, central groove of piston 59, pipe 65, valve 56, (bypassed their feed valve assembly 2), heater 32, and intake valve 20 which is opened, and discharging their pressure over the upper face of piston 12, starting the rotation of crankshaft 11.

At the same time the working fluid flows through the reduced orifice "K", pushing the piston 59, downwardly.

As soon as the crankshaft 11 begins to rotate, the intake valve 20, which corresponds to the first expansion cylinder 15 will open and working fluid trapped inside its heater 32, from valve 46 was closed, discharges its pressure over piston 12, with the pressure reached inside of the heater 32, and the work from said piston 12 will be added to the work of the piston 12, of the third cylinder 15, and continuing until the exhaust valve 21, of the third cylinders 15, will be opened, and the working fluid, begins to exhaust to atmosphere through the exhaust manifold 66, but, in the meantime piston 12 of second cylinder 15 will pass the respective top dead center, acting as previously described for piston 12, for first cylinder 15.

At the same time when piston 12, of third cylinder 15, has rotated the initial 60° after crossing over their bottom dead center the camshaft 22 pushes the lower spring plate 50, corresponding its feed valve 2, to its top stroke, and valve 46 will be free and will be opened by the working fluid pressure, thus starting the heating of the "next working fluid charge" inside the heater 32, for when piston 12 passes its top dead center and intake valve 20 will be opened, and the working fluid will be discharged again over the second and first pistons 12, and so forth in the three expansion cylinders 15.

At the same time, the compression cylinders 14, will be replenishing the working fluid used on heaters 32, and expansion cylinders 15.

WORKING FLUID

As engine 8 has a long time working fluid heating, lasting through rotation of about 340° of the crankshaft 11, or in other words, 95% of the time at which the engine is running, which is obtained while the heating is made during and simultaneously with the exhust and expansion cycles, the working fluid should have the necessary physical properties, according to engine 8.

As the maximum working fluid volume which may be supplied continuously is that supplied by compression cylinders 14, it is necessary not to reduce and exhaust the volume stored in reservoir 26 so each heater 32 must have the same volume as those supplied for each compression cylinder 14, at each compression stroke at the pressure governed by the unloader valve 27.

On the other hand, it is necessary that the working fluid should be a gas with low thermal conductivity such as air or carbon dioxide which absorbs the lowest wall heat from heater 32, during the time at which it will be filling, to avoid an early expansion. In this example air is preferred due to the fact it can be easily drawn from atmosphere, used and returned to the environment. Air expansion due to discharge from the feed valve assembly 2, outlet end, and intake end heater 32, produces a temperature reduction which avoids or reduces to a minimum the early air expansion when it exhausts through valve 46 and fills the heater 32 before valve 46 closes. For this reason it is considered that air will have approximately the same temperature as reservoir 26, at the instant valve 46 closes, and will be trapped in heater 32, where begins the heating at true constant volume, and the final pressure reaching inside the heater 32, will be equal to the pressure inside reservoir 26, multiplied by the working fluid temperature which is reached inside the heater 32, divided by the temperature of reservoir 26. Heaters 32, acting as compression chambers and the working fluid pressure discharged over the upper face of pistons 12, on the expansion cylinders 15, is higher than the pressure produced for the compression cylinders 14, and the expanded air volume is the same as that discharged by each compression cylinder 14, at each stroke at the pressure governed by unloadeder valve 27.

The above considerations for the use of air or carbon dioxide as a working fluid are hypothetically based only on their thermal conductivity, but a more suitable kind of working fluid for a given engine 8, is determined by other factors such as:

Crankshaft 11, rotational speed
Compression cylinders 14, discharging pressure
Heater 32, wall temperature
Working fluid speed when entering the heaters 32
Heaters 32, configuration
Working cycle (see Claim 4).

THEORETICAL ENGINE PERFORMANCE

Engine 8 performance is based on the fact that it has the same number of compression cylinders 14, and expansion cylinders 15, with same bore and stroke, the working fluid heating being true at a constant volume, and their compression and expansion being isothermal. First, there is considered only the volume of heaters 32, without any additional volume due to accumulators 30, and there are constant values for the working fluid:

Temperature inside reservoir 26—17° C.
Final temperature inside heaters 32—700° C.
Pressure inside reservoir 26—7.2 $K/cm^2$ In FIG. 4, at their T.D.C., left side, is shown the working fluid evolution pressure inside the heaters 32. The "B" designated circle indicates the instant at which the valve 46 closes.

On the right hand side T.D.C., the full line shows the pressure gradient on the expansion cylinders 15, over pistons 12.

The dotted line shows the compression pressure developed inside the compression cylinders 14, and the horizontal line at the 5.6 level identifies the medium effective pressure.

WORKING FLUID ACCUMULATORS 30, ADDITION

If the volume of the accumulator 30 is added to heater 32, it will increase the total working fluid volume trapped inside them, which will result in a higher pressure in the expansion cylinder 15 against the piston 12 during the expansion cycle, which is given for the working fluid pressure trapped at both accumulator and heater, multiplied by the volume sum of working fluid trapped inside heater 32, plus the volume of accumulator 30 and divided by the sum of the volume of heater 32 plus volume of accumulator 30, plus volume of expansion cylinder 15, at each given time, which goes from a volume equaling that of the heater 32, plus accumulator 30, up to the maximum when exhaust valve 21, opens.

As the working fluid heating is by forced convection the maximum final temperature reached is determined by the wall heater temperature, and will be about the same for any working fluid volume, the rather small temperature reached when accumulator 30 is added, is due to accumulators 30 being heated only by the combustion gases whence maximum temperature reached will be about the same in any case.

The volume of accumulators 30, which is added to the heaters 32, will change the expansion ratio, giving as a result that the pressure during the expansion cycle and the medium effective pressure, increase.

Increasing the medium effective pressure, the output torque is also increased, increasing also the power at the same rate as the speed of pistons 12 increases.

Figure 4:
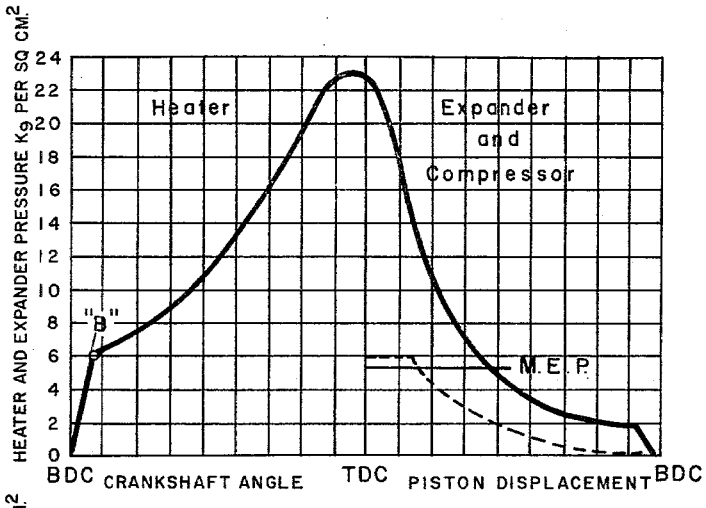
FIG. 4 is a performance diagram of the engine.
Figure 5:
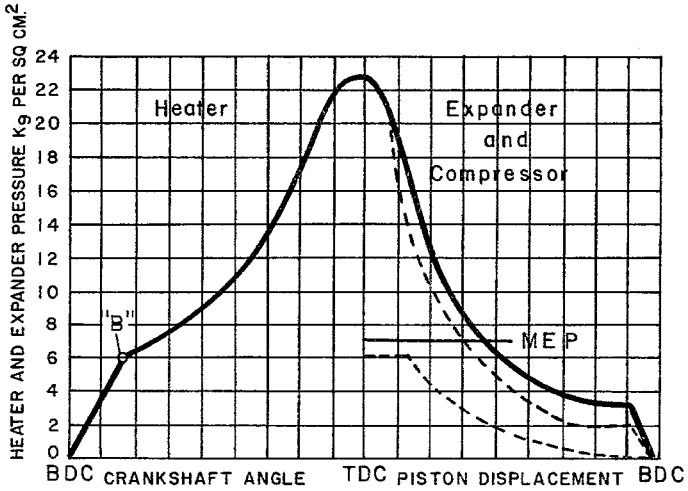
FIG. 5 is a performance diagram of the engine, adding the working fluid accumulators with a volume equal to 50% of heaters volume.

In FIG. 5, the dotted line indicates the same performance as engine 8, as shown on FIG. 4, and the line in full is the performance adding total volume of accumulator 30, which has a capacity equalling 50% of that of the heater 32, and gives a medium effective pressure increased to 7.0 $Kg/cm^2$ which is 1.25 higher than those shown on FIG. 4.

As the torque and power developed by crankshaft 11 are controlled by the working fluid added or decreased to the volume of the heaters 32, it is possible to achieve an output torque maximum at zero velocity and approximate inversely proportional to the crankshaft 11, rotational speed as those required by the automotive or railroad vehicles, with a sequence as follows:

From 0 rpm (0 kph) to maximum speed in rpm or kph

1—Accumulator 30, with maximum volume, and by means of unloader valve 27, the compression cylinders are sent to idle.
2—The compression cylinders are sent to compression.
3—To reduce the volume of accumulators 30, from maximum to minimum.
4—Total suppression of accumulators 30.

MODIFICATIONS

The previous mentioned engine 8, corresponds to its basic form, but it may be modified by one of the following devices:

Feed valve assembly 2, with its outlet duct configuration as a "Venturi nozzle" for increasing the working fluid speed and kinetic energy.

A cooling coil placed between the feed valve assembly 2, outlet duct and inlet end to heaters 32, to reduce the temperature in this zone, and to avoid an early working fluid expansion.

The starting up of the engine 8 can be improved with the use of some commercial compressed air rotating distributor 25 as those known and used for starting some Diesel engines, said rotating distributor can be driven by any of the camshaft 22 or 23, and must have one distribution element for each expansion cylinder 15, and must be placed between each pipe 65, said rotating distributor permits the flow of working fluid from reservoir 26 only at the same angle as the expansion pistons are dephased between them, this angle beginning from the bottom dead center of the respective expansion piston 12, and ends before its exhaust valve 21 opens, which prevents any loss in the working fluid in those expansion cylinders 15 whose expansion pistons 12 are beyond the point of aperture of exhaust valve 21 when the valve 54 is lifted for start up the engine 8. This rotating distributor is automatically withdrawn from working fluid circuit as soon as the central groove of piston 59 closes the orifice "L" interrupting the flow of working fluid throughout the pipes 65.

Figure 6:
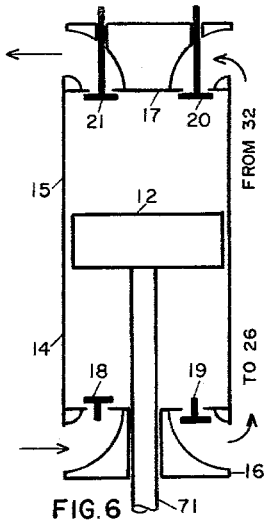
FIG. 6 is a schematic view of a compression and expansion cylinder combined into a single cylinder.

Other possible arrangements of the compression and expansion cylinders are:

A. All the engine cylinders 14 and 15, can function as compressor and as expanders such as shown in FIG. 6, where said cylinders are closed at both ends by means of cylinder heads 16 and 17, the upper portion of the cylinders acting as compressor and the lower portion acts as expander, it being required that the piston 12 be connected to a stem 71 which is connected to the engine connecting rod 13 by means of a movable pin.

Figure 7:
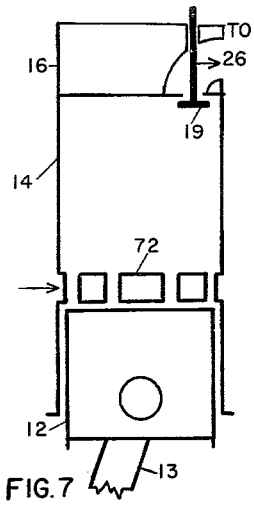
FIG. 7 is a schematic view of a compression cylinder where the admission of working fluid is accomplished through the cylinder ports.
Figure 7A:
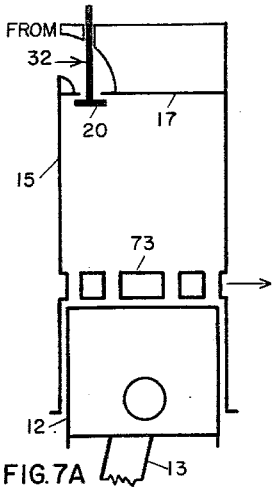
FIG. 7A illustrates an expansion cylinder where the exhaust of working fluid is accomplished through the cylinder ports.

B. FIG. 7 shows a cylinder arrangement where the suction of the working fluid to the compression cylinders 14 is accomplished through the cylinder ports 72 and the discharge of the compressed working fluid through the discharge valve 19, whereas FIG. 7A shows an expansion cylinder 15 in which the admission of heated working fluid is accomplished through the intake valve 20, and the exhaust of working fluid through the cylinder ports 73.

Figure 8:
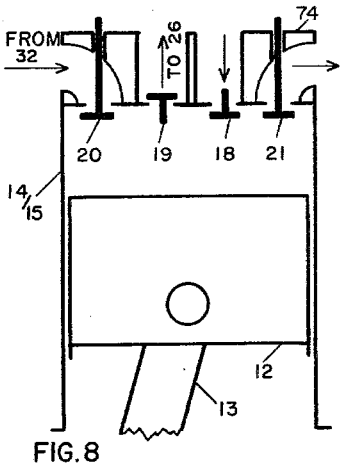
FIG. 8 illustrates a cylinder which combines the suction, compression, expansion and exhaust strokes, during two engine crankshaft revolutions.

C. In order to increase considerably the heating time of the working fluid if compared with the present Stirling cycle engines for high speed engines all the engine cylinders can function as compressors and as expanders over the upper face of the pistons 12, as shown in FIG. 8, and it is necessary that each of the engine cylinder heads 74 have one suction valve 18, one discharge valve 19, one intake valve 20, and one exhaust valve 21, it being required that each two crankshaft revolutions produce four strokes which are: (1) working fluid suction; (2) working fluid compression; (3) heated working fluid admission; and (4) working fluid exhaust, in a form similar to the four cycle internal combustion engines. This engine arrangement is more appropriate for a high speed engine which has very short time to perform the working fluid heating.

Figure 9:
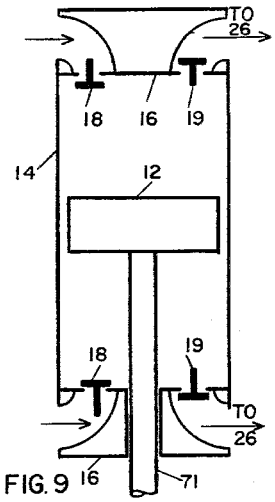
FIG. 9 illustrates a double acting compression cylinder which performs the suction and compression strokes simultaneously.
Figure 9A:
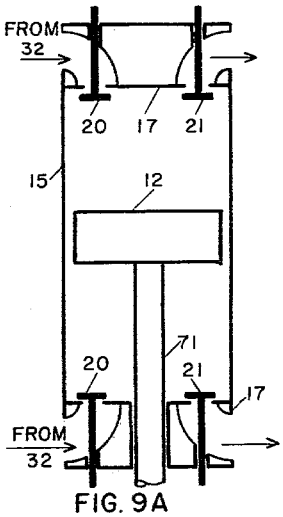
FIG. 9A illustrates a double acting expansion cylinder which performs the intake and exhaust strokes simultaneously.

D. An engine where the compression cylinders 14 function as double acting cylinders is shown in FIG. 9, whereas FIG. 9A shows double acting expansion cylinders 15; in this case, in the compression cylinders, each stroke becomes an intake stroke over one face of the compression piston 12, and a compression stroke over the other face of the compression piston whereas in the expansion cylinders 15, the expansion piston 12 admits hot working fluid alternatively over each of their faces at every stroke and at the same time over the opposite face of the expansion piston the exhaust of working fluid is accomplished.

E. For an engine which often is required to function at low rotational speed and to develop high torque a great volume of working fluid is required in order to fill the heaters 32 and the accumulators 30, it is possible to have double acting compression cylinders 14, as those shown in FIG. 9, and single acting expansion cylinders 15.

Figure 10:
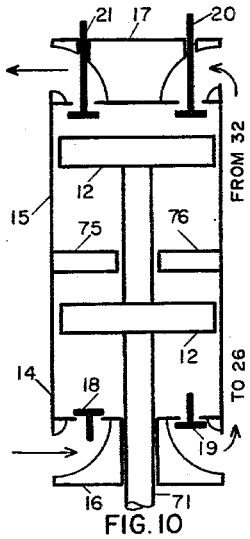
FIG. 10 illustrates a cylinder divided by a central partition forming two chambers, with a compression and expansion piston in each chamber.

F. An engine which combines the compression and expansion pistons within a single cylinder divided by a central partition 75 is shown in FIG. 10 where the lower portion of the cylinder is the compression cylinder 14 which has in the lower end the cylinder head 16 equipped with the suction valve 18 and the discharge valve 19, the upper portion of the cylinder comprising the expansion cylinder 15, which has in its upper end the cylinder head 17 equipped with the intake valve 20, and the exhaust valve 21, the stem 71 passing through the central partition 75 and maintaining the compression and expansion pistons in fixed spaced relation, the lower end of stem 71 being connected to the connecting rod 13 (not shown) by means of a movable pin.

Figure 11:
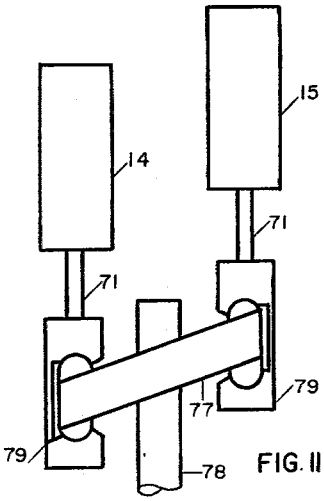
FIG. 11 illustrates an engine compression cylinder and one expansion cylinder acting over a swash plate.

G. Other arrangements of the engine compression cylinders 14 and expansion cylinders 15 are shown in FIGS. 6, 9, 9A, and 10 in which the pistons 12 are connected to the stem 71, and as shown in FIG. 11, all the engine compression cylinders 14 and expansion cylinders 15 are arranged radially around a central axle 78, and each of the stems 71 acting by means of suitable means 79 over a swash plate 77 which is fixed to the central axle 78.

Figure 12:
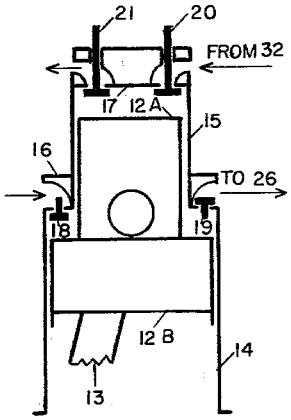
FIG. 12 illustrates an engine cylinder containing the compression piston and the expansion piston stepped with different diameters and coupled together.

H. An engine cylinder arrangement which combines the compression and expansion pistons coupled together within a single cylinder of stepped different diameters, is shown in FIG. 12. In this case the compression cylinders 14 and the expansion cylinders 15 do not have any partition between them, the only virtual partition between the compression cylinder 14 and the expansion cylinder 15 is created by the geometric configuration of the stepped diameter between the compression piston 12A and the expansion piston 12B.

Although this invention has been described by a specific embodiment and example, it will be obvious to one skilled in the art that its teachings may be employed in other ways, and the scope of the invention should not be deemed to be limited by the precise certain embodiments, and modifications herein described, disclosed, illustrated and shown, since other embodiments and modifications are intended to be reserved where they fall within the scope of the claims herein appended.

I claim:

1. A self starting hot gas engine with means for changing the expansion ratio therein, comprising a bank of cylinders which includes at least one compression cylinder for compressing a working fluid, each of said compression cylinders having a cylinder head including means for controlling the suction and discharge of the working fluid, heaters for heating the working fluid, said compression cylinders supplying the compressed working fluid to be heated in said heaters; a second bank of cylinders comprising at least one expansion cylinder where the working fluid heated in said heaters is expanded, each of said expansion cylinders having a cylinder head including means for controlling the intake and exhaust of the heated working fluid, said expansion cylinders producing the total engine power; a piston in each of said compression and expansion cylinders, a connecting rod carried by each of said pistons, a cylinder block in which is mounted a crankshaft, each of said connecting rods being connected to said crankshaft, said cylinder block including actuator means for filling said heaters with working fluid and for opening and closing the intake and exhaust valves in said expansion cylinders at predetermined times, said means for controlling the discharge of said compressed working fluid, and each one of said compression cylinders being connected to discharge compressed working fluid to a compressed working fluid reservoir, a starting and throttle valve assembly connected to an outlet duct of said compressed working fluid reservoir, a feed valve assembly for each of said expansion cylinders connected to said assembly of start and throttle valves, said feed valve assembly comprising a check valve which is actuated by said actuator means for filling said heaters and by the pressure of the working fluid flowing through said feed valve assembly, said check valve comprising means to prevent back flow of working fluid from said heaters toward said compressed working fluid reservoir, a working fluid accumulator connected to the outlet duct of each of said feed valve assembly comprising means for changing the gas volume which can be stored in said accumulators and said heaters and which is the gas volume to be expanded in its respective expansion cylinder; each feed valve assembly being connected to its respective heater, said heaters being located within a combustion chamber which includes means for supplying and ignition of the fuel, each one of said heaters being connected to each one of said expansion cylinders and forming a gas flow circuit between said compression and said expansion cylinders, an auxiliary compressor connected to said gas flow circuit before said start and throttle valve assembly, said auxiliary compressor acts to maintain fully charged with pressurized working fluid said compressed working fluid reservoir, means connected to said gas flow circuit for governing the delivery of compressed working fluid to said compressed working fluid reservoir and for placing in idle said compression cylinders.

2. The engine as disclosed in claim 1, characterized in that said compression cylinders accomplish the working fluid admission through cylinder ports, whereas the exhaust of working fluid is also accomplished through cylinder ports.

3. The engine as disclosed in claim 1, characterized in that said compression pistons and said expansion pistons are stepped with different diameters which are coupled together as a single unit, and function within the respective cylinders and whose gas volume are independent between them.

4. The engine as disclosed in claim 1, characterized in that all said engine cylinders function as compressors and as expanders, said cylinder heads having means for controlling the suction and discharge when functioning as compressors, and for intake and exhaust of working fluid when functioning as expanders, a minimum of four strokes being required to cover suction and compression when acting as compressors, and expansion and exhaust when acting as expanders.

5. The engine as disclosed in claim 1, characterized in that said compression cylinders are replaced by said expansion cylinders which act as expanders in its downward stroke, and as compressors in its upward stroke, and a duct connecting the exhaust of each of said cylinders to said compressed working fluid reservoir to allow said engine to function within a closed circuit formed by said cylinders and said compressed working fluid reservoir.

6. The engine as disclosed in claim 1, characterized in that in both banks of said cylinders all the cylinders function for compression over one side of said pistons, and as expanders on the opposite side of said pistons, said cylinders having a cylinder head in each end which receives said suction and discharge means on the compression side, and said intake and exhaust means on the expansion side, said pistons being connected to a stem passing through the cylinder heads closest to said engine crankshaft, said stem being connected by a movable pin with one end of said connecting rod, the other end of the connecting rod being connected with said engine crankshaft, which at every revolution produces simultaneously an expansion stroke in the expansion cylinder side, and a compression stroke on the compressor cylinder side, the stroke in the opposite direction creating an exhaust action on the expander side, and an intake on the compressor side.

7. The engine as disclosed in claim 6, characterized in that in said compression cylinders each stroke becomes an intake stroke, over one face of each of said compression pistons and a compression stroke over the other face; in the bank of said expansion cylinders, during each stroke said expansion pistons admits the hot working fluid alternatively over each one of its faces, and at the same time, over the opposite face of said expansion pistons the exhaust of working fluid is accomplished.

8. The engine as disclosed in claim 6, characterized in that in said compression cylinders each stroke becomes an intake stroke over one face of said compression pistons, and a compression stroke over the opposite face; whereas in said expansion cylinders during one stroke said expansion pistons admit hot working fluid over one face only, the exhaust of working fluid being accomplished on the opposite stroke.

9. The engine as disclosed in claim 6, characterized in that said compression pistons and said expansion pistons are fixed in spaced relation by one of said stems, ach piston group functioning within one of said cylinders which have a central partition which is crossed over by said stem to obtain two separate cylinders, one being utilized as a compressor and the other as an expander.

10. The engine as disclosed in claim 6, characterized in that said compression cylinders, and said expansion cylinders are arranged radially around a common center axis, and each one of said stems are used as push rods, and act directly over a swash plate in lieu of said cranshaft.

* * * * *

UNITED STATES PATENT AND TRADEMARK OFFICE

CERTIFICATE OF CORRECTION

PATENT NO. : 4,183,219
DATED : January 15, 1980
INVENTOR(S) : Eduardo Ayala Vargas It is certified that error appears in the above—identified patent and that said Letters Patent is hereby corrected as shown below:

On The Title Page, Item 19, should read

-- Ayala Vargas --.

On The Title Page, Item 76, should read

-- Eduardo Ayala Vargas

Av. Bogota 697

Mexico 14, D. F. Mexico --.

Signed and Sealed this

*Twenty-ninth* Day of *April 1980*

[SEAL]

*Attest:*

SIDNEY A. DIAMOND

*Attesting Officer*

*Commissioner of Patents and Trademarks*